United States Patent [19]

Jungmann

[11] Patent Number: 4,473,261

[45] Date of Patent: Sep. 25, 1984

[54] SWIVEL JOINT FOR A LID

[75] Inventor: Manfred Jungmann, St. Georgen, Fed. Rep. of Germany

[73] Assignee: Schwarzwälder Elektronik-Werke GmbH, Villingen-Sxhwenningen, Fed. Rep. of Germany

[21] Appl. No.: 273,141

[22] Filed: Jun. 12, 1981

[51] Int. Cl.[3] ..... B65D 41/00; B65D 43/24

[52] U.S. Cl. ..... 312/319; 312/284; 312/24; 220/331; 217/60 E

[58] Field of Search ..... 312/319, 284, 24, 27, 312/30; 217/60 E; 220/331, 335

[56] References Cited

U.S. PATENT DOCUMENTS

| | | | |
|---|---|---|---|
| 773,721 | 11/1904 | Duvall | 312/319 |
| 2,143,218 | 1/1939 | Thurner | 312/24 |
| 2,790,690 | 4/1957 | James | 312/319 |
| 2,802,711 | 8/1957 | Ulrich, Sr. | 312/319 |
| 3,049,390 | 8/1962 | Wolfe | 312/319 |
| 3,930,594 | 1/1976 | Jungmann | 312/335 |
| 4,167,298 | 9/1979 | Plattner | 312/319 |

FOREIGN PATENT DOCUMENTS

| | | | |
|---|---|---|---|
| 7314633 | 4/1973 | Fed. Rep. of Germany . | |
| 7631920 | 10/1977 | Fed. Rep. of Germany . | |
| 723294 | 2/1955 | United Kingdom | 312/24 |

*Primary Examiner*—Victor N. Sakran

*Attorney, Agent, or Firm*—Horst M. Kasper

[57] ABSTRACT

A swivel joint for a lid for the detachable application of the lid to a cabinet, having a lever mechanism which is under spring biasing, the lever mechanism permitting a weight-balanced raising of the lid and, upon raising, pulling the pivot pin of the joint in positive fashion forward so that the rear upper edge of the lid does not extend beyond the cabinet, as seen in the perpendicular direction.

6 Claims, 4 Drawing Figures

SWIVEL JOINT FOR A LID

Figure 1:
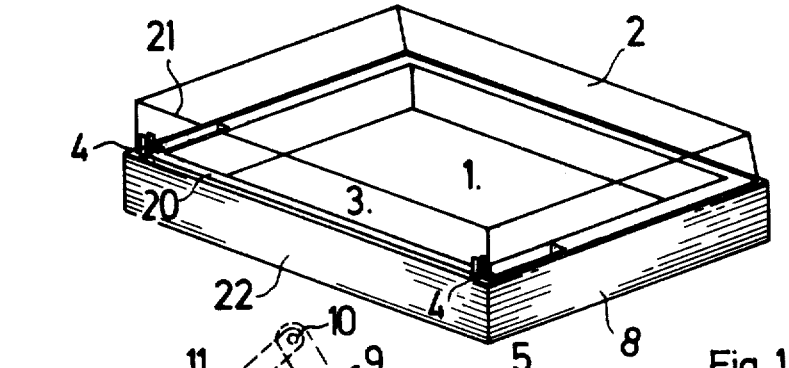

The present invention relates to a swivel joint for the lid of a cabinet, having a holding part for applying the lid to the cabinet, said holding part containing a slot-shaped recess into which the vertical rear wall of the lid can be engaged and on which spring means act to produce a moment of rotation which, from a given angle of opening of the lid counterbalances the moment of rotation produced by the weight of the lid itself, but is substantially weaker in the range of opening below same.

Swivel joints of this construction are characterized by the fact that, on the one hand, they make possible a weight-balanced lifting of the lid so that the lid remains in any desired position of opening, insofar as such positions are of practical importance. On the other hand, however, the lid is not under load in the vicinity of the swivel joint in the closed position so that no return spring force acts and, insofar as plastic is used no fatigue phenomena can occur either. Furthermore with swivel joints, the lid can also be readily lifted off or placed on, in its closed position, which is advantageous when the cabinet is located in a niche which is of restricted height.

In the case of one known swivel joint of this type (West German Pat. No. 24 23 007) the holding part for the lid is swingable around a pivot pin which is fixed in the cabinet and located below the lid. This arrangement has the disadvantage that when the lid is swung open its rear upper edge is swung out beyond the cabinet and the cabinet cannot be placed with its rear side against a wall.

In accordance with another known arrangement pursuant to West German Gebrauchsmuster No. 76 31 920, this problem has been solved in the manner that the pivot axis of the joint is placed approximately at the mid-height of the lid and a relief spring is arranged behind the hinge pin. This, however, means a shortening of the rear wall of the lid and does not permit a release from load of the swivel joint and the lid parts connected to it in the closed position.

In accordance with another known arrangement pursuant to West German Gebrauchsmuster No. 73 14 633 this problem has been solved in the manner that the pivot axis of the joint was on the one hand moved upward, but in addition to this it was also mounted for displacement in vertical direction. The counterbalancing of the weight is obtained in the manner that a lower edge of the lid rests in front of the pivot and the pivot axis is pulled downward by a spring. In this case a reduction of the moment of rotation produced by the spring, to be sure, is also present in the closed position. The place where the joint acts on the lid, however, remains under maximum load. Furthermore, it is necessary, in the case of this arrangement also that the vertical rear wall of the lid be shortened or lie in front of the swivel pin, which then, however, does not permit an optimum utilization of the space and requires an unattractive, complicated shape of the lid. Furthermore, with this manner of producing the moment of rotation unfavorable frictional conditions result.

In contradistinction to the two embodiments just described, the present invention proceeds from a type of joint such as described in the preamble to the specification and/or the embodiment first described. Its object is to make such a type of joint usable for placing the rear wall of a cabinet against a wall without impairing the above-mentioned advantages of such type of hinge.

Its solution is characterized in accordance with the invention by the fact that the holding part (4) contains, in the region of the lower edge (20) of the inserted lid rear wall (3), a pivot (6) which is horizontally displaceable towards the front on the side wall (8) of the cabinet (1) in a longitudinal guide (7) and contains an arm (9) which extends from the region of the pivot (6) of the holding part (4), is directed towards the front and lies substantially parallel to the longitudinal guide (7), the free end (10) of said arm (9) being pivotally connected with a level (11, 16), the opposite end of which is held on the side wall (8) of the cabinet (2) by a pivot (12), and by the fact that the spring means (13, 18) are provided which act in such a manner on the lever system (9, 11; 9, 16) formed by arm (9) and lever (11, 16) that, in the closed position of the lid (2), they produce a substantially smaller moment of rotation in the holding part than that produced by the weight of the lid (2) itself, the position of the spring means (13, 18) with respect to the lever system (9, 11; 9, 16) and the spring constant being so selected that upon the lifting of the lid (2) up to the specified angle of opening, the lever system (9, 11; 9, 16) is swung to such an extent that the effective lever arm of the spring means (13, 18) has so increased with respect to the lever system (9, 11; 9, 16) that the moment of rotation acting on the holding part (4) thereby is equal to that produced by the weight of the lid (2) itself, and the relaxing of the spring means (13, 18) which is caused by the lifting of the lid (2) acquires upon the further lifting of the lid (2), a greater influence on the moment of rotation of the lever system (9, 11; 9, 16) than the increase of its effective lever arm so that from that point on there is again a decrease of the moment of rotation on the holding part (4), the value of which is adapted approximately to that produced by the weight of the lid (2) itself in the corresponding position.

Furthermore in accordance with the invention the spring means comprises a tension spring (13) which acts on the holding part (4) in the region of the pivot (6) of the latter and lies essentially with its longitudinal axis parallel to the longitudinal guide (7) of the pivot (6).

Further in accordance with the invention, the lever is developed as a double-arm bell-crank lever (16) with vertex (19) located at the bottom, and a compression spring (18), whose pressing direction in the closed position of the lid (2) is directed approximately towards the cabinet-side pivot (12) of the bell-crank lever (16), acts on said vertex point (19).

Furthermore in accordance with the invention the cabinet-side pivot (12) of the bell-crank lever (16) is guided for longitudinal displacement in horizontal direction and the vertex point (19) of the bell crank lever (16) is guided in a longitudinal guide (23) which extends substantially vertically.

With the above and other objects and advantages in view, the present invention will become more clearly understood in connection with the detailed description of preferred embodiments, when considered with the accompanying drawings, of which:

FIG. 1 shows a cabinet 1 having a lid 2, the vertically arranged rear wall 3 of which is inserted into two holding parts 4 pivotally supported on the cabinet 1.

Figure 2:
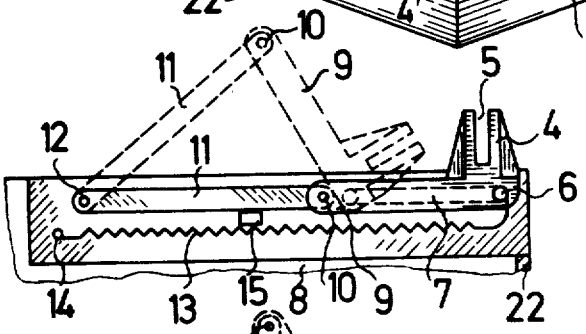
Figure 3:
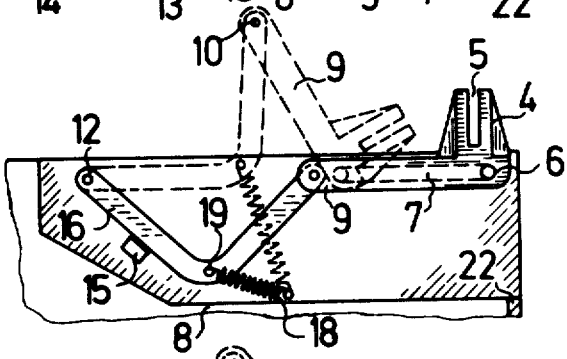
Figure 4:
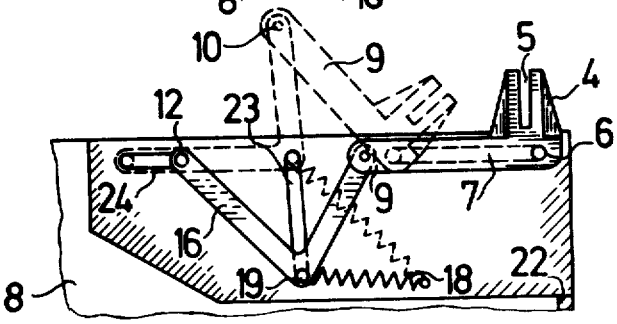

FIGS. 2 to 4 show various embodiments for the development of the joint mechanism of which the holding part 4 for the lid 2 forms a part.

The holding part 4 forms a slot-shaped opening 5 in which the rear wall 3 of the lid 2 is held by mere insertion. The holding part is held on the side wall 8 of the cabinet 1 by a pivot 6 which is displaceable in a longitudinal guide 7 and the holding part 4 includes an arm 9 which is connected at its end 10 to a lever 11 (FIG. 2), which in its turn is held at its other end to the side wall 8 of the cabinet 2 by a pivot 12. A tension spring 13 acts on the holding part 4 near its pivot 6, the other end 14 of said spring being fastened to the side wall 8 of the cabinet 2. The guide 7 is formed in the side wall 8.

In the closed position of the lid 2 (position shown in the drawing), the tension spring 13 cannot produce any moment of rotation on the holding part 4 and can also not move it in its longitudinal guide 7. Such movement is prevented by the fact that the lever system formed of the arm 9 of the holding part 4 and of the lever 11 represents an elbow-lever system in stretched position. In the practical embodiment it is advisable to limit the downward movement of the lever 11 by a stop 15 in order to give it a precisely defined position. Application with slight pressure against this stop 15 can be obtained by a slight shifting of the stop 15 downward or by a slight lengthening of the point of action of the spring to above the pivot 6 of the holding part 4. Upon the raising of the lid 2 the lid is pulled forward by the action of the elbow-lever system 9, 11, the lower edge 20 of its rear wall 3 moving precisely in the horizontal plane of the upper edge of the cabinet to such an extent that the upper edge 21 of its rear wall 3 does not protrude beyond the real wall 22 of the cabinet as seen in the perpindicular direction.

Upon lifting to a predetermined angle, which may suitably be about 10°, the moment of rotation acting on the holding part 4 increases rapidly to its maximum value by the bending of the elbow-joint system 9, 11, said maximum value corresponding to the weight of the lid 2 itself. The spring constant of the tension spring 13 is selected in such a manner that the decrease in the tension force of the spring 13 as a result of its progressive shortening continuing on from this angle of opening, exerts a greater influence on the moment of rotation of the holding part 4 than the further increase in the effective lever arm, so that the moment of rotation caused thereby also decreases upon further opening in agreement with the moment of rotation produced by the weight of the lid 2 itself.

In the embodiment shown in FIG. 3, the lever is developed as a bell crank lever 16, which in itself has no effect on the course of movement of the lever system 9, 16. As a spring there is used in this case a compression spring 18 which acts at the vertex 19 of the bell crank lever 16. In order that it produces none or only a small moment of rotation, if any, on the bell crank lever 16 in the closed position of the lid 2, its direction of force is directed essentially towards the pivot 12 of the bell crank lever 16. The course of the moment of rotation produced by it in the holding part 4 corresponds in principle to that which was described in connection with the embodiment of FIG. 2.

In the embodiment shown in FIG. 4, the pivot 12 of the bell crank lever 16 is arranged for horizontal displacement in a longitudinal guide 24. In this case the lever system 9, 16 is imparted a defined position by a constraining positive longitudinal guide 23 for the vertex 19 of the bell crank lever 16 which extends substantially vertically. In this way the course of moment of the lever system 9, 16 can be determined more freely and the course of the moment of rotation acting on the holding part 4 can be adapted optimally to the moment of rotation resulting from the weight of the lid itself. However, it should be noted that a very precise couunterbalancing of the moment of rotation arising from the weight of the lid itself is not necessary since the joint also has a certain amount of friction of its own which, in case of a certain deviation of the counterbalancing moment, holds the lid 2 fast in the desired open positions. The guides 23 and 24 are formed in the side wall 8 of the cabinets.

In all embodiments in addition to other advantages in any selected opening position greater than the predetermined opening angle the lid is held fast by the spring.

I claim:

1. A joint for the swingable application of a lid having at least one vertically standing rear wall, onto a cabinet, comprising a holding part having a slot-shaped recess into which the vertically standing rear wall of the lid is insertable, a pivot located on the holding part adjacent said recess in a region of a lower edge of the rear wall of the lid, a horizontally extending longitudinal guide in a side wall of the cabinet slidably receives the pivot of the holding part, said holding part includes an arm having ends and directed forwardly starting from a region of said pivot of the holding part, said arm being substantially parallel to said longitudinal guide in a closed position of the lid on the cabinet, a lever having one end supported by a second pivot on the side wall of the cabinet and having its other end turnably connected to a forward free end of the arm, said arm of said holding part and said lever comprise a lever system, spring means for acting on said lever system with a force and direction of action of the spring means being selected such that in the closed position of the lid a moment of rotation caused thereby which acts on the holding part is substantially smaller than a moment of rotation produced by the weight of the lid itself and that, upon the opening of the lid into a predetermined position the lever system is swung into a position in which the effective lever arm of the spring means has so increased with respect to the lever system that the moment of rotation acting on the holding part caused thereby reaches approximately the amount of the moment of rotation produced in opposite direction by the weight of the lid itself, and a relaxation of the spring means caused by the raising of the lid upon the further lifting of the lid has a greater influence on the moment of rotation of the lever system than the increase in its effective lever arm so that from that point on there is a decrease in the moment of rotation of the holding part caused thereby, the amount of which corresponds approximately to the moment of rotation produced by the weight of the lid itself in its instantaneous position.

2. The joint according to claim 1, wherein said spring means is a tension spring which acts on the holding part in the region of said first-mentioned pivot, said spring means defines a longitudinal axis substantially parallel to said longitudinal guide.

3. The joint according to claim 1, wherein said lever is formed as a double-arm bell-crank lever having a vertex located below the ends of said arm, said spring means is a compression spring which acts on said lever in a region of said vertex of said bell-crank lever with a direction of force directed substantially towards said second pivot of said lever when said lid is in the closed position.

4. The joint according to claim 3, further comprising a second longitudinal guide displaceably receives said second pivot of said lever, said second longitudinal guide being arranged substantially horizontally in the side wall of the cabinet, a third longitudinal guide extends substantially vertically in the side wall of the cabinet, a third pivot is disposed on the vertex of said bell-crank lever, said third pivot being longitudinally displaceably supported in said third longitudinal guide.

5. The joint according to claim 1, wherein said arm is connected in one-piece to said holding part.

6. The joint according to claims 1, 2 or 3, further comprising a stop is vertically adjustably disposed on said side wall under said lever and engages the latter with slight force in the closed position.

* * * * *